US009822607B2

(12) United States Patent
Vick, Jr.

(10) Patent No.: US 9,822,607 B2
(45) Date of Patent: Nov. 21, 2017

(54) CONTROL LINE DAMPER FOR VALVES

(75) Inventor: James Dan Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 213 days.

(21) Appl. No.: 14/409,842

(22) PCT Filed: Jul. 12, 2012

(86) PCT No.: PCT/US2012/046475

§ 371 (c)(1),
(2), (4) Date: Dec. 19, 2014

(87) PCT Pub. No.: WO2014/011178

PCT Pub. Date: Jan. 16, 2014

(65) Prior Publication Data

US 2015/0233209 A1 Aug. 20, 2015

(51) Int. Cl.

| | |
|---|---|
| ***E21B 34/14*** | (2006.01) |
| ***E21B 34/16*** | (2006.01) |
| ***E21B 34/10*** | (2006.01) |

(52) U.S. Cl.

CPC ..... *E21B 34/14* (2013.01); *E21B 34/10* (2013.01); *E21B 34/16* (2013.01)

(58) Field of Classification Search

CPC ..... E21B 34/10; E21B 34/14; E21B 34/16
USPC ..... 166/374, 375
See application file for complete search history.

(56) References Cited

U.S. PATENT DOCUMENTS

| | | | | |
|---|---|---|---|---|
| 4,036,297 | A * | 7/1977 | Swihart, Sr. | E21B 43/121 166/250.01 |
| 4,467,867 | A | 8/1984 | Baker | |
| 6,405,803 | B1 * | 6/2002 | Giroux | E21B 34/06 137/14 |
| RE38,866 | E * | 11/2005 | Myhre | E21B 23/04 166/106 |
| 7,392,849 | B2 | 7/2008 | Lauderdale et al. | |
| 2006/0278395 | A1 | 12/2006 | Kenison et al. | |
| 2009/0242199 | A1 | 10/2009 | Basmajian et al. | |

OTHER PUBLICATIONS

International Search Report and Written Opinion issued in related PCT Application No. PCT/US2012/046475 dated Feb. 19, 2013, 14 pages.

* cited by examiner

*Primary Examiner* — Giovanna C Wright
*Assistant Examiner* — Manuel C Portocarrero
(74) *Attorney, Agent, or Firm* — Scott Richardson; Baker Botts L.L.P.

(57) ABSTRACT

A downhole tool actuation system comprises a control line in fluid communication with a control fluid source, a first piston assembly comprising a first surface in fluid communication with the control line, and a damper piston assembly comprising a second surface in fluid communication with the first surface. The first piston assembly is configured to actuate the downhole tool.

20 Claims, 10 Drawing Sheets

CONTROL LINE DAMPER FOR VALVES

CROSS-REFERENCE TO RELATED APPLICATIONS

This application is a U.S. National Stage Application of International Application No. PCT/US2012/046475 filed Jul. 12, 2012, which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations containing hydrocarbons to allow recovery of the hydrocarbons. During the drilling and production of a hydrocarbon bearing formation, various procedures may be performed that involve temporarily isolating fluid flowing between the surface of a wellbore and the formation through a wellbore tubular. Such procedures can include flow control operations, completion operations, and/or interventions. Various valves, including safety valves, may be used during these procedures to control the flow of fluid through the wellbore tubular.

Safety valves may be inserted deep in a well, as deep as 10,000 feet or more for example. Operating safety valves at these depths poses several problems, including delays in valve closure time and potential damage to components of the safety valve. A typical safety valve is actuated when a pressure differential in a control line of the safety valve displaces a piston, which in turn displaces a flow tube opening a flapper. The control line is generally designed to withstand a pressure greater than the pressure needed to compress a biasing device, for example a spring, which typically requires a relatively high pressure rating for the control line.

SUMMARY

In an embodiment, a downhole tool actuation system comprises a control line in fluid communication with a control fluid source, a first piston assembly comprising a first surface in fluid communication with the control line, and a damper piston assembly comprising a second surface in fluid communication with the first surface. The first piston assembly is configured to actuate the downhole tool. The system may also include a third piston assembly comprising a third surface in fluid communication with the control line, and the damper piston may be in fluid communication with the third surface. In an embodiment, the damper piston assembly is not configured to actuate the downhole tool. The first piston assembly and the damper piston assembly may be disposed in a body member of the downhole tool, and the damper piston assembly may be radially offset from the first piston assembly. The damper piston assembly may be disposed externally to the downhole tool. The first piston assembly and the damper piston assembly may be disposed within about 300 feet of each other. The damper piston assembly may comprise a damper piston disposed within a damper piston chamber, and a first end of the damper piston may be configured to engage a first end of the damper piston chamber with a metal-to-metal engagement. A second end of the damper piston may be configured to engage a second end of the damper piston chamber with a metal-to-metal engagement.

In an embodiment, a downhole valve actuation system comprises a control line in fluid communication with a control fluid source, an actuation piston assembly in fluid communication with a control line, and a damper piston assembly in fluid communication with the control line. The actuation piston assembly is configured to actuate the valve, and the damper piston assembly is configured to receive a portion of fluid displaced from the actuation piston assembly. The portion of the fluid displaced from the actuation piston assembly may be sufficient to allow a valve closure member to be displaced over about 50% of its travel. The actuation piston assembly may comprise an actuation piston chamber, and the portion of fluid the damper piston may be configured to receive is about 0.5% to about 100% of the volume of the actuation piston chamber. The actuation piston assembly may comprise an actuation piston chamber, and the damper piston assembly may comprise a damper piston chamber. The ratio of a volume of the damper piston chamber to a volume of the actuation piston chamber may be between about 1:1 to about 1:100. The system may also include a second actuation piston assembly in fluid communication with the control line, and the second actuation piston assembly may be configured to actuate a second valve. The damper piston assembly may be configured to receive the portion of fluid displaced from the actuation piston assembly during the closing of the valve.

In an embodiment, a method comprises providing a fluid at a first pressure to a first piston assembly, wherein the first piston assembly comprises a first piston disposed in a first piston chamber, and wherein the first piston is in an actuated state, reducing the first pressure to a second pressure, transitioning the first piston assembly from the actuated state to an un-actuated state in response to the second pressure, and transferring at least a portion of fluid in the first piston chamber to a damper piston assembly during the transitioning. The first piston may be operatively coupled to a valve closure member, the valve closure member may provide fluid communication through a valve in the actuated state, and the valve closure member may isolate fluid communication through the valve in the un-actuated state. The transferring may comprise reducing a force applied to the first piston assembly. The first piston assembly may transition from the actuated state to an un-actuated state faster than a comparative piston assembly that does not transfer the portion of the fluid. The method may also include receiving, by the damper piston assembly, a second portion of fluid from a second piston assembly during the transitioning.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
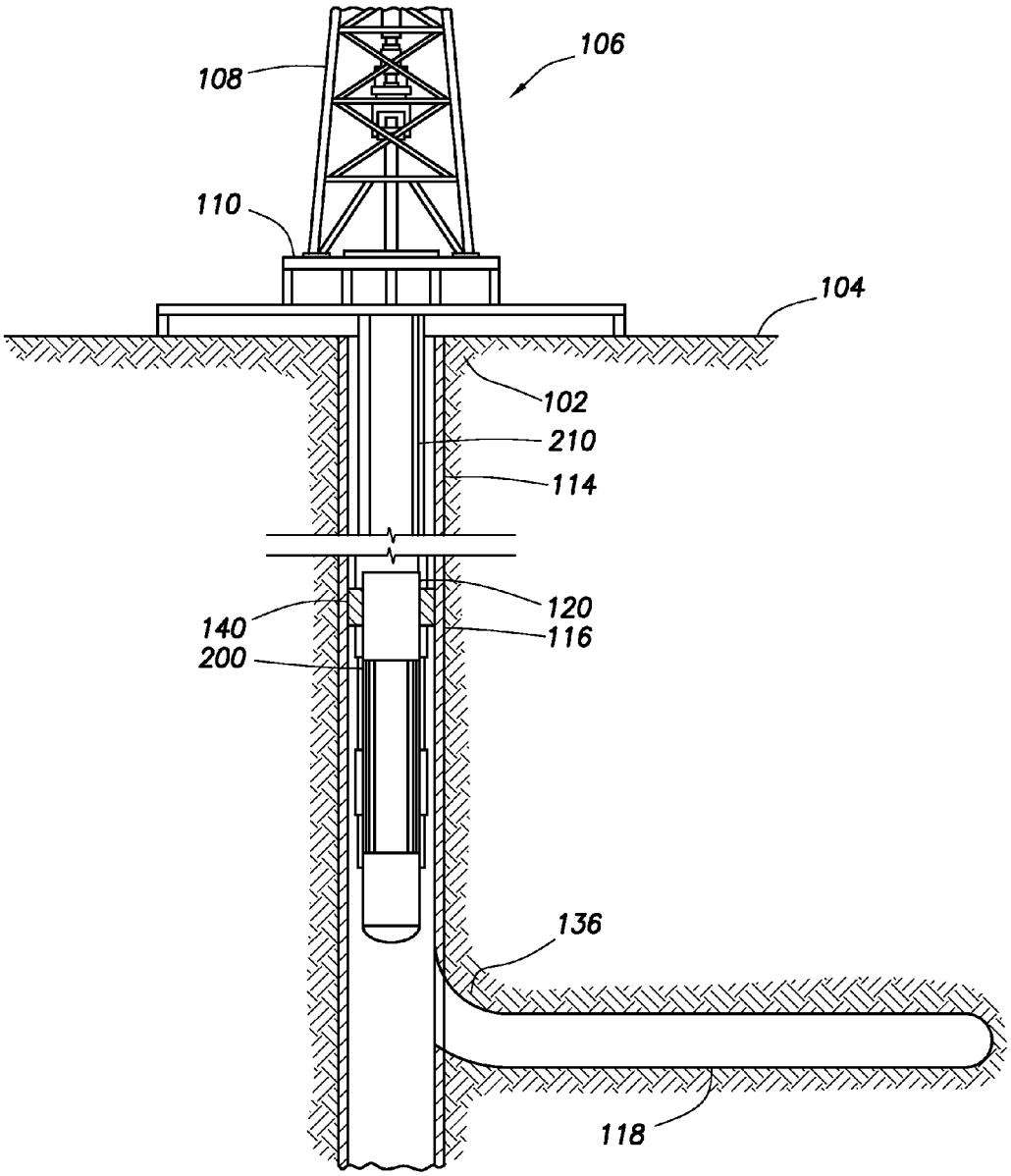
FIG. 1 is a schematic view of an embodiment of a subterranean formation and wellbore operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

Referring to FIG. 1, an example of a wellbore operating environment in which a valve 200 may be used is shown. As depicted, the operating environment comprises a workover and/or drilling rig 106 on the earth's surface 104 that extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both production wells and injection wells.

A wellbore tubular string 120 comprising a valve 200 may be lowered into the subterranean formation 102 for a variety of reasons during the life of a wellbore 114. In an embodiment, the valve 200 may comprise a safety valve that can be used to prevent flow through the wellbore tubular 120 for operational considerations and/or in the event of damage to the wellhead. The embodiment shown in FIG. 1 illustrates the wellbore tubular 120 in the form of a production tubing string comprising a packer 140 disposed in the wellbore 114. It should be understood that the wellbore tubular 120 comprising the valve 200 is equally applicable to any type of wellbore tubular being inserted into a wellbore as part of a procedure needing fluid isolation from above or below the valve, including as non-limiting examples drill pipe, segmented pipe, casing, rod strings, and coiled tubing. Further, a means of isolating the interior of the wellbore tubular string 120 from the annular region between the wellbore tubular string 120 and the wellbore 114 wall may take various forms. For example, a zonal isolation device such as a packer (e.g., packer 140), may be used to isolate the interior of the wellbore tubular string 120 from the annular region to allow for the valve 200 to control the flow of a fluid through the wellbore tubular 120. In some embodiments, the wellbore tubular string 120 comprising the valve 200 may be used without any additional zonal isolation device (e.g., a packer).

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for extending the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 comprising the valve 200 within a land-based wellbore 114, in alternative embodiments, mobile workover rigs, wellbore servicing units (such as coiled tubing units), and the like may be used to lower the wellbore tubular 120 comprising the valve 200 into the wellbore 114. It should be understood that a wellbore tubular 120 comprising the valve 200 may alternatively be used in other operational environments, such as within an offshore wellbore operational environment.

Regardless of the type of operational environment in which the valve 200 is used, it will be appreciated that the valve 200 serves to control the flow of fluid with a wellbore between a formation and the surface of a wellbore through a wellbore tubular or conduit. As safety valves are installed at deeper and deeper depths, the length of the control line used to control the safety valves also increases. As a result, problems may be encountered with a hydraulic control signal from the surface such as a delay in valve closure time. Further, when the closure member is approaching its closed position, the fluid in the wellbore may impinge on the closure member of the safety valve and try to force the flapper to move rapidly from partially closed to fully closed, creating a large pressure spike in the control line pressure and causing the closure member to "slam shut." Damage to closure member components such as the hinge and/or hinge pin may occur during these types of slam closures. For example, as the closure member is forced by the fluid in the wellbore to close, the closure member hinge, hinge pin, and/or actuator may undergo stress and can become damaged.

In an embodiment, the valve 200 may comprise a damper piston configured to receive a portion of control fluid used to actuate the valve 200. The portion of the fluid may allow the valve to close faster than it otherwise would without the damper piston, thereby reducing a force applied to various components of the valve 200. The configuration of the damper piston to receive the portion of the control fluid may also allow the sealing member (e.g., a flapper in a flapper-type valve) to snap shut without needing to displace the control fluid through the entire length of the control line. Rather, the fluid may be displaced into the damper piston and allowed to flow through the control line after the valve 200 has closed. While the following discussion describes a wellbore tubular 120 with a valve 200, it should be understood that any plurality of valves 200 and/or any plurality of damper piston assemblies may be used in one or more wellbore tubular 120 strings to achieve the results and advantages described herein.

Figure 2:
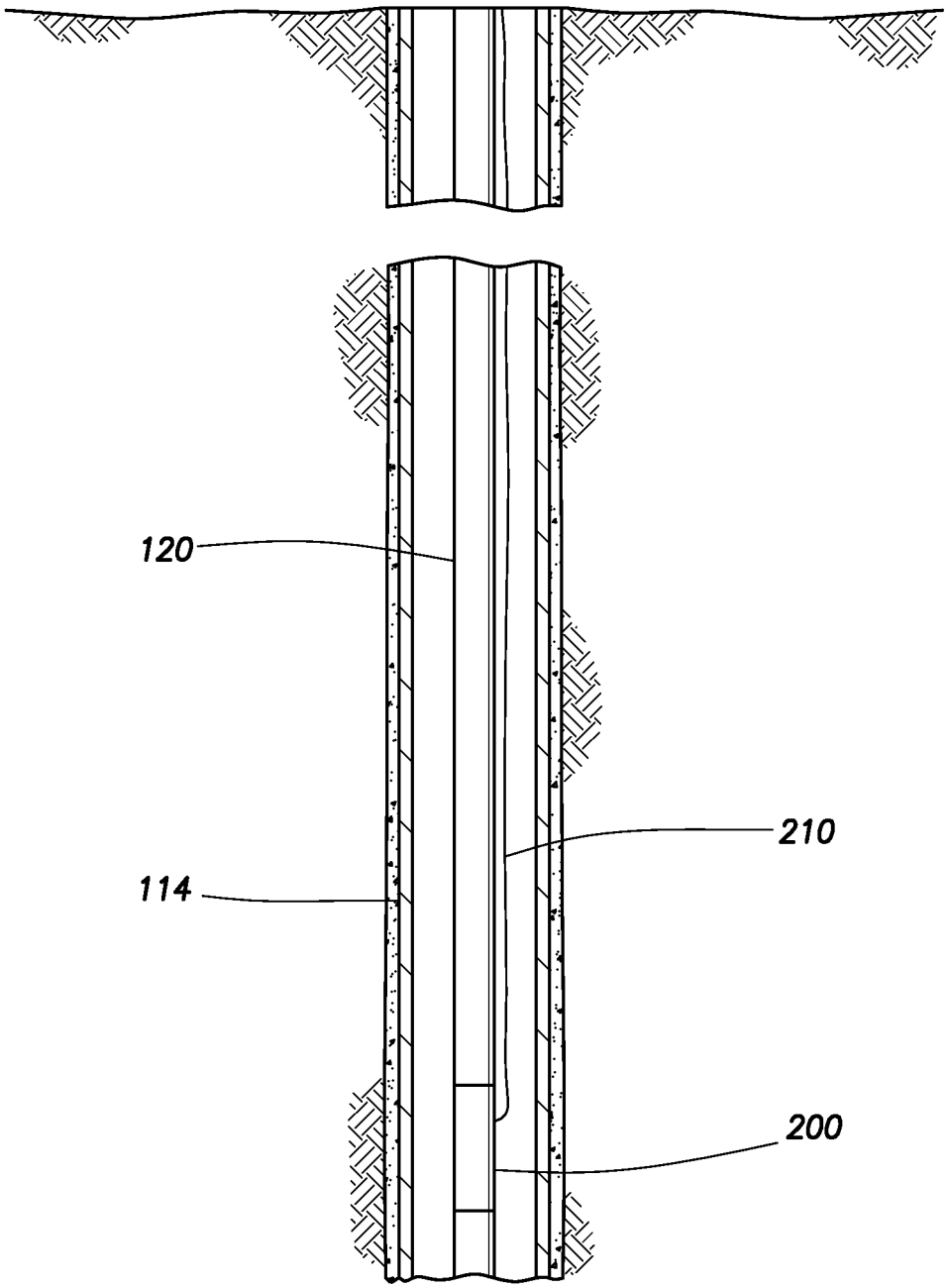
FIG. 2 is another schematic view of an embodiment of a subterranean formation and wellbore operating environment.

A closer view of the valve 200 disposed within the wellbore 114 as schematically illustrated in FIG. 1, is shown in FIG. 2. As illustrated, the valve 200 is positioned within the wellbore 114. A control line 210 extends into the wellbore 114 and is coupled to the valve 200. The control line 210 provides a control fluid to the valve 200 to actuate the valve 200 between an open position and a closed position. In an embodiment, the control line 210 comprises a hydraulic control line. Pressure can be applied to the control line 210 from a remote location (e.g., the surface) to actuate the valve 200. In an embodiment, the valve 200 may be biased closed so that a pressure supplied through the control line above a threshold opens the valve, and a pressure below the threshold actuates the valve 200 to the closed position. Though the control line 210 is depicted in FIG. 2 as being external to the wellbore tubular string 120, it will be appreciated that any control line may be used to convey actuation pressure to the valve 200. For example, the control line could be internal to the wellbore tubular string 120, or formed in a sidewall of the tubular string. The actuation pressure could be generated by a pump or other pressure generation device in fluid communication with the control line 210.

Referring to FIGS. 3A-3D, an embodiment of a valve is illustrated in successive cross-sectional views. The valve 200 of this embodiment comprises a generally tubular body member 205 with a longitudinal bore 260 that extends therethrough. One or both ends of the body member 205 may comprise a connection mechanism, such as threads, for interconnection with another downhole component, tubular, or tool, for example the wellbore tubular used to convey and/or retain the valve 200 within the wellbore. An actuator 250, usually referred to as a flow tube, may be disposed within the body member 205 and is configured to axial translate between the open position of the valve and the closed position of the valve within the body member 205. The actuator 250 includes a biasing member 245 such as a spring disposed about the actuator 250 that acts upon a shoulder 255 on the actuator 250, thereby biasing the actuator 250 away from a closure member 275 (e.g., a flapper). Note that biasing members other than a spring may be utilized in the valve 200 without departing from the principles of the present invention, for example, the spring could be replaced by a chamber of compressible gas, such as nitrogen. The closure member 275 is mounted within the body member 205 to control fluid flow through the longitudinal bore 260.

Figure 3A:
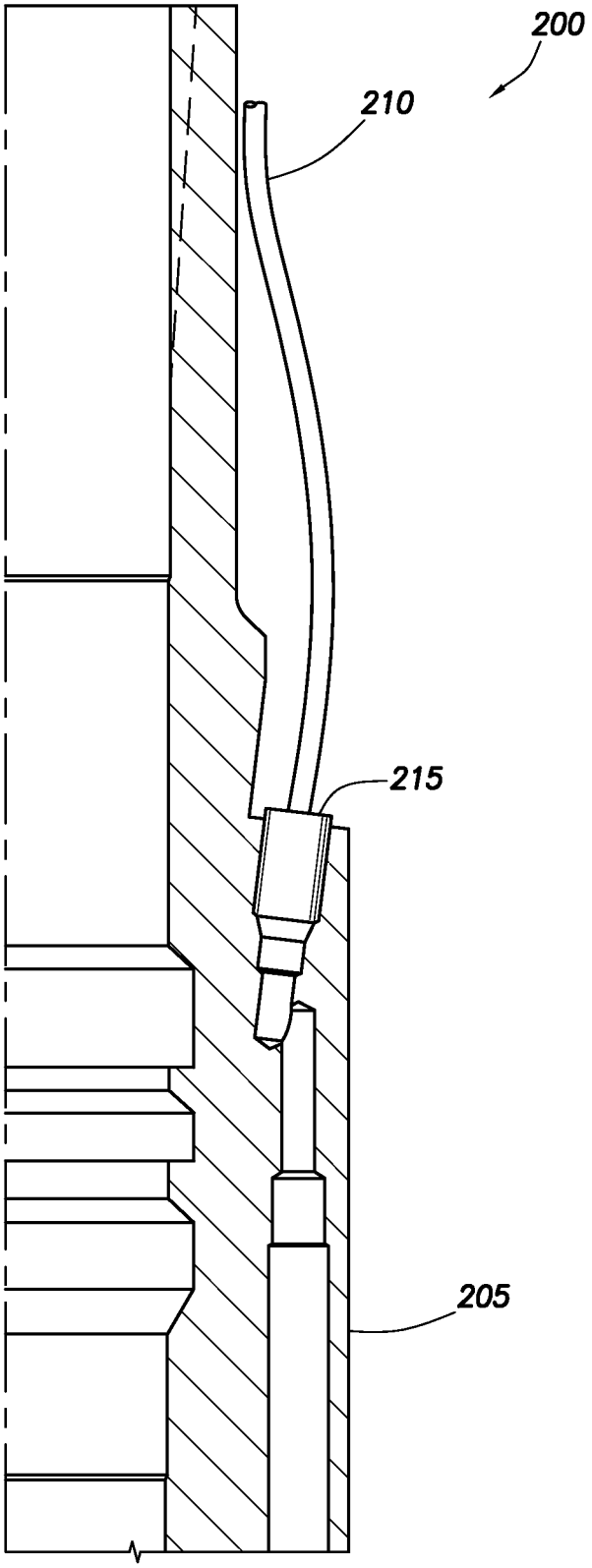
FIG. 3A-D are partial cross-sectional views of successive axial sections of an embodiment of a valve.
Figure 3B:
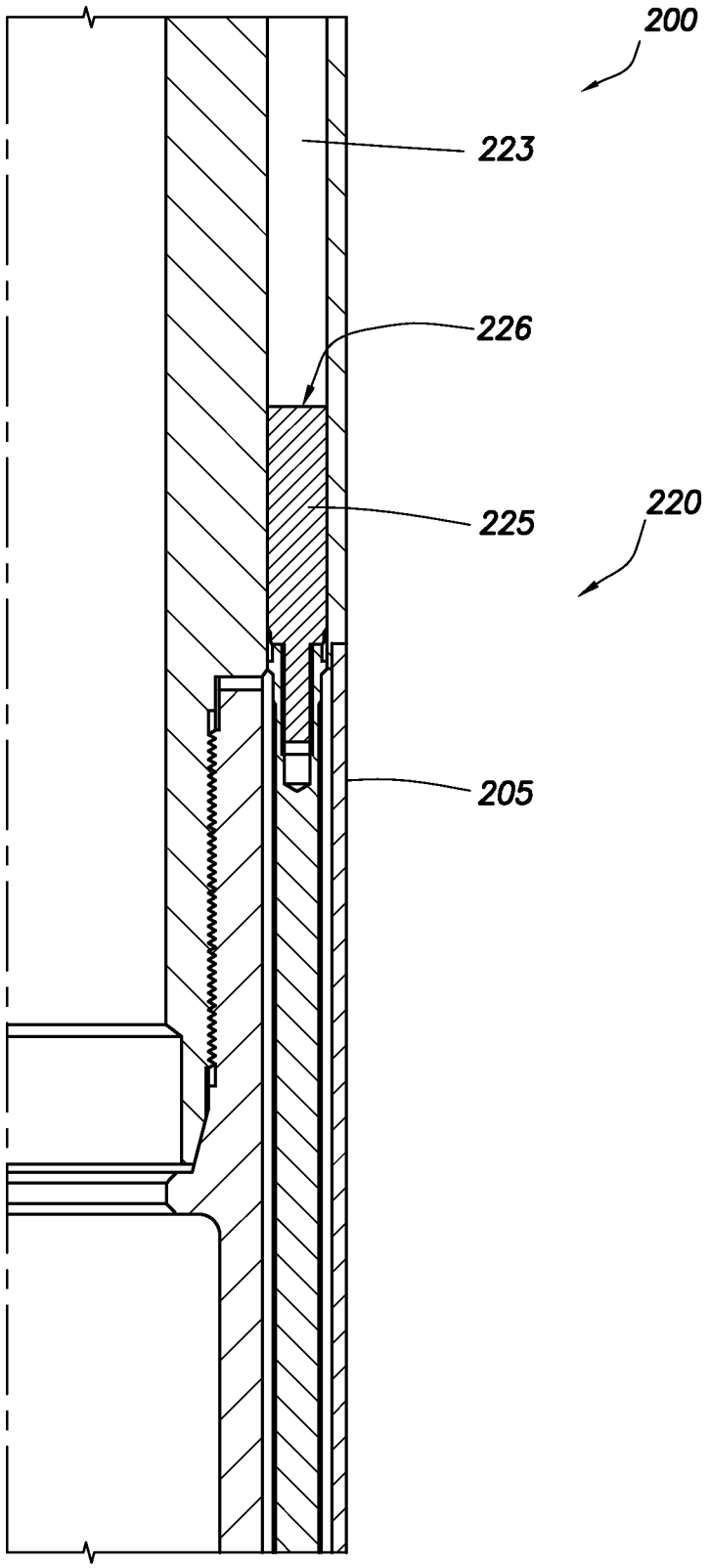

In an embodiment, a rod-piston system 220 (or other hydraulic operating piston, such as an annular piston) may be provided to controllably translate the actuator 250 within the longitudinal bore 260, and to actuate the closure member 275 between an open position and a closed position or a closed position and an open position. The valve 200 may generally comprise a control line inlet 215 that can be connected to the control line 210 and provide a control fluid to a piston 225. The piston 225 can be sealably mounted for reciprocal movement within a piston rod chamber 223, which may be located within the wall of the tubular body member 205. Once connected to the control line inlet 215, the control line 210 is placed in fluid communication with the piston 225 in the piston rod chamber 223. A first end of the piston 225 comprising a first surface 226 may be in contact with hydraulic fluid provided thereto through the relatively small diameter control line 210. A second end 228 of the piston 225 is operatively connected, in any suitable manner, to the actuator 250. When the pressure of hydraulic fluid in the control line 210 exceeds the force needed to compress the biasing member 245, the piston 225 is forced downwardly, thereby causing the actuator 250 to come into contact with, and open, the closure member 275. In the event that the hydraulic pressure applied to the piston 225 is decreased, the biasing member 245 forces the actuator 250 upwardly away from the closure member 275. The closure member 275 is then rotated, and biased, into a closed position by action of a hinge 270 and hinge spring 280 to a normally closed position (as shown in phantom in FIG. 3D) to prevent fluid flow into the actuator 250 and through the longitudinal bore 260. Though only a single piston rod assembly 220 is illustrated in FIG. 3B, it should be understood that any type and quantity of pistons may be used.

Figure 4B:
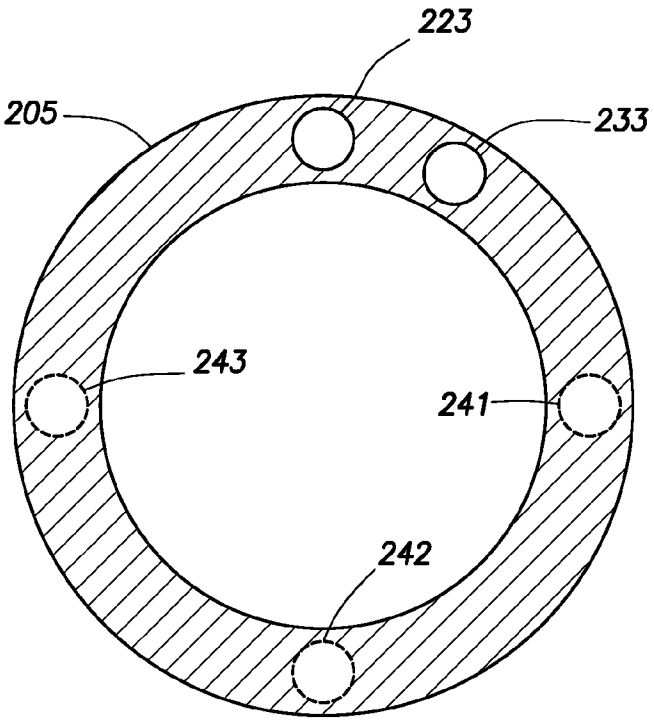
FIG. 4B is a cross-sectional view of a valve according to an embodiment.
Figure 3C:
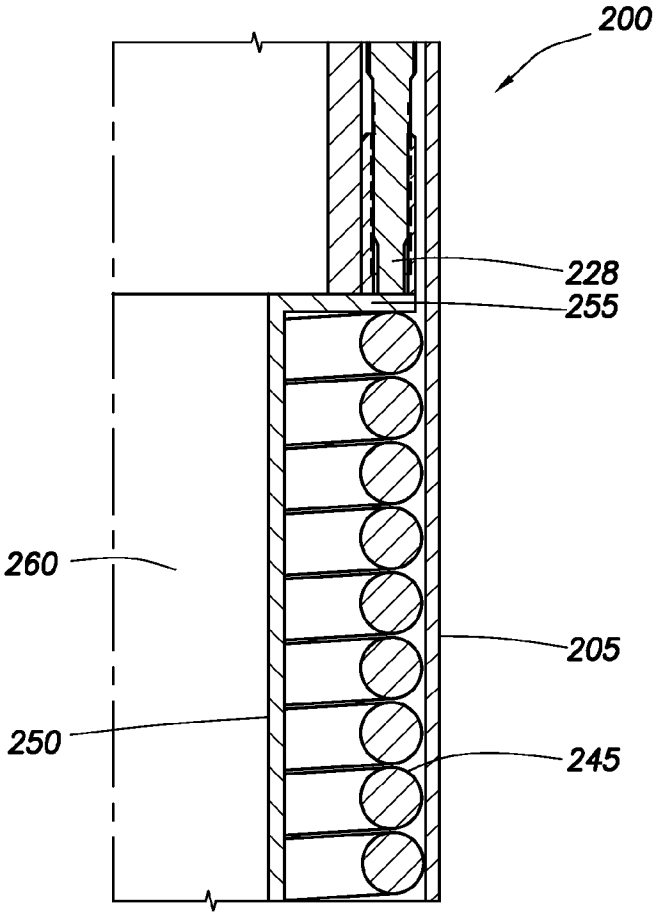
Figure 3D:
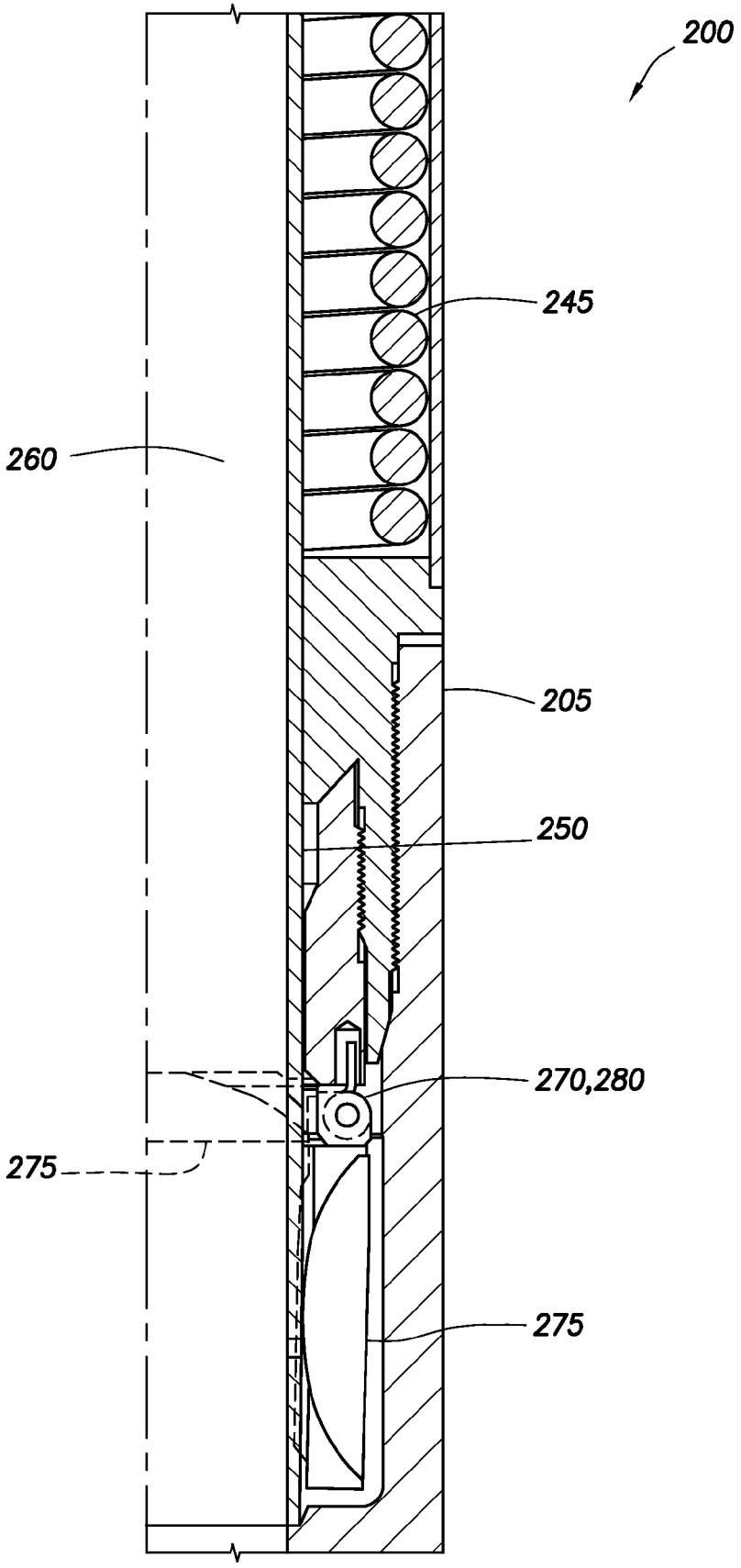
Figure 4A:
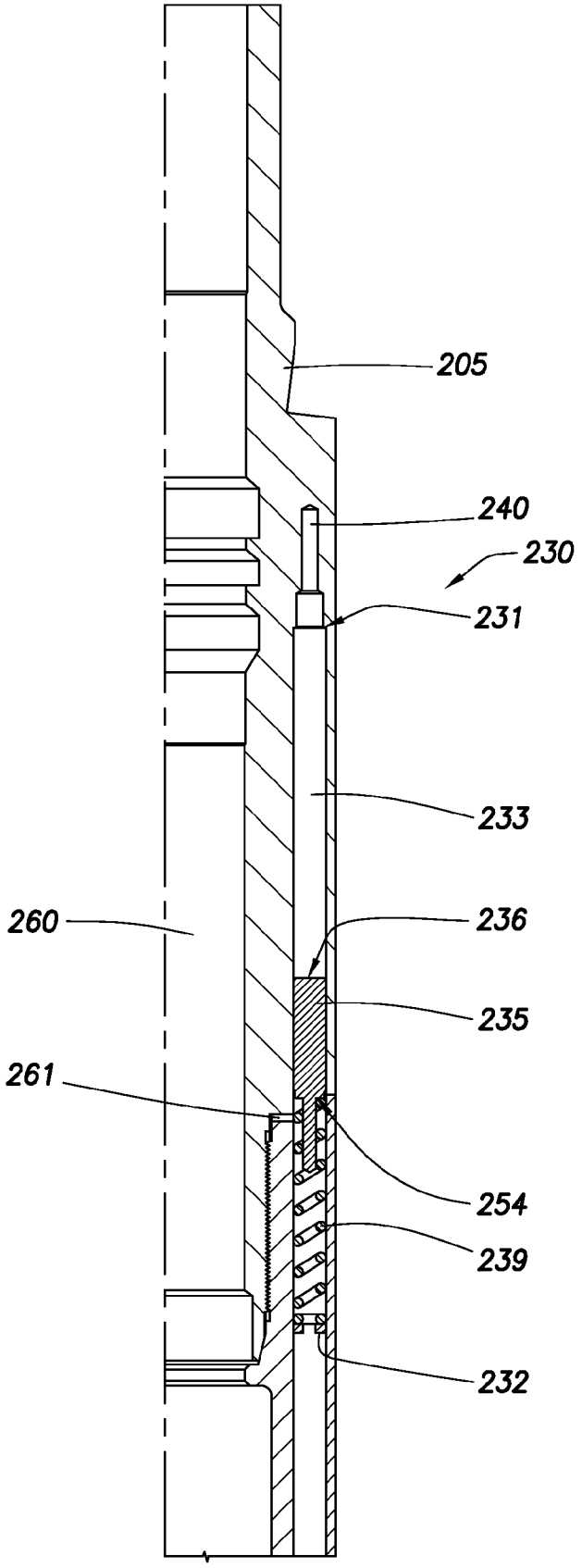
FIG. 4A is a partial cross-sectional view of a piston assembly according to an embodiment.

Referring to FIGS. 4A and 4B, an embodiment of a damper piston assembly 230 is illustrated as being disposed within the body member 205 of the valve 200. The damper piston assembly 230 comprises a damper piston 235 sealably mounted for reciprocal movement within a damper piston chamber 233. A fluid inlet 240 can be in fluid communication with the control line coupled to the valve 200 (e.g., control line 210 and/or control line inlet 215) and the damper piston 235. A first end 236 of the damper piston 235 may be in contact with the control fluid provided thereto through the control line 210 and fluid inlet 240. A biasing member 239 such as a spring disposed within the piston chamber 233 acts upon a second end 254 of the damper piston 235, thereby biasing the damper piston 235 towards a first end 231 of the piston chamber 233. Note that biasing members other than a spring may be utilized in the valve 200 without departing from the principles of the present invention, for example, the spring could be replaced by a chamber of compressible gas, such as nitrogen, in which embodiment the fluid port 261 may not be present. In an embodiment, the damper piston 235 biasing member 239 may have a higher spring force than the spring force of the power piston 225 biasing member 245.

The first end 236 of the damper piston 235 may be configured to engage the first end 231 of the piston chamber 233 with a metal-to-metal engagement, thereby providing a sealing engagement at the metal-to-metal contact. A fluid port 261 may provide fluid communication with the longitudinal bore 260 of the valve 200 to allow the damper piston 235 to translate within the piston chamber 233. When the fluid port 261 is in fluid communication with the longitudinal bore 260, the pressure of the longitudinal bore 260 may be operating against both the damper piston 235 and the piston 225. The control line pressure may then be selected to overcome the biasing force of the biasing members in each piston assembly as well as the longitudinal bore 260 pressure (e.g., greater than the sum of the longitudinal bore 260 pressure and actuation pressure). When the fluid port 261 and the second end of the piston 225 are in fluid communication with the longitudinal bore 260, the common pressure acting on the damper piston 235 and the piston 225 allow the relative operating pressure between the pistons 225, 235 to remain substantially the same.

While the fluid port 261 is illustrated as being in fluid communication with the longitudinal bore 260, other configurations are possible. In an embodiment, the fluid port 261 may be in fluid communication with a different fluid source. For example, the fluid port 261 may provide fluid communication with an annulus pressure (e.g., a wellbore pressure exterior to the valve 200), which may be higher or lower than the longitudinal bore 260 pressure. In an embodiment, the fluid port 261 may be coupled to a pressure from a different region of the wellbore, thereby providing a pressure that is different than the ambient pressure on the piston 225. In some embodiments, the fluid port 261 may be coupled to a separate control line. The control line may provide a greater or lesser pressure than the pressure of the longitudinal bore 260. The use of a control line may allow the pressure acting on the second side of the damper piston 235 to be controlled for a selected operating pressure of the damper piston assembly 230. In still another embodiment, a pressure source may be coupled to the fluid port 261. For example, a pressurized gas reservoir (e.g., a nitrogen charge or chamber) may be used to supply a desired pressure and/or provide the desired biasing force to the damper piston 235.

When the pressure of hydraulic fluid in the control line 210 exceeds the force needed to compress the biasing member 239, the damper piston 235 is forced downwardly, thereby allowing a portion of the control fluid to flow into the damper piston chamber 233. When fully compressed, a second end 254 of the damper piston 235 may be configured to engage a second end (e.g., stop 232) of the piston chamber 233 with a metal-to-metal engagement, thereby providing a sealing engagement at the metal-to-metal contact. In an embodiment, the contact point between the second end 254 of the damper piston and the second end 232 of the piston chamber may occur at a shoulder formed along an inner surface of the piston chamber 233, thereby allowing the biasing member 239 to be disposed within a lower portion of the piston chamber 233. In an embodiment, the travel of the damper piston 235 within the damper piston chamber 233 may be limited to a portion of the length of the damper piston chamber 233.

The damper piston chamber 233 may be located within the wall of the tubular body member 205 in a generally parallel orientation to the piston rod chamber 223 as illustrated in the top-down cross-sectional view of FIG. 4B. As illustrated, the damper piston chamber 233 may be disposed within the wall of the tubular body member 205 adjacent the piston chamber 223 and radially offset from the piston chamber 223. While illustrated as being radially offset between about 10 degrees and 30 degrees, the damper piston chamber 233 may be radially offset to any point about the circumference of the body member 205. Further, one or more piston chambers 223, 233 may be used with the valve 200, for example at optional piston chamber locations 241, 242, 243. In an embodiment, two or more damper piston chambers 233 may be placed at any point within the wall about the body member 205. A fluid port (e.g., the fluid inlet 240 of FIG. 4A) may be used to fluidly couple the control line inlet 215 to the damper piston chamber 233. When a plurality of piston chambers 223 and/or damper piston chambers 233 are present, a fluid port may couple the inlet control line to one or more of the chambers 223, 233 and/or multiple control lines may be used to actuate the valve 200.

In some embodiments, a damper piston assembly 230 may be disposed outside the valve 200. In this embodiment, the damper piston chamber 233 may be disposed in a damper piston housing having a fluid inlet 240 in fluid communication with the control line 210. The damper piston assembly 230 may otherwise be constructed the same as or similar to the damper piston assembly 230 disposed within the valve 200. The disposed damper piston assembly 230 may be configured to accept a portion of the control line fluid during the actuation of the valve 200. The disposed damper piston assembly 230 may be within a distance of the valve 200 so that the control fluid can be received without excessive fluid resistance in the fluid communication pathways (e.g., fluid inlet 240, control line 210, etc.) In an embodiment, the damper piston assembly 230 may be disposed within about 300 feet, within about 250 feet, within about 200 feet, within about 150 feet, within about 100 feet, within about 50 feet, or within about 30 feet of the valve 200 and/or one or more actuation pistons actuating the valve 200.

In an embodiment, the damper piston assembly 230 is generally configured to accept a portion of the control fluid displaced from the piston chamber 223 to allow the valve closure member to quickly actuate over at least a portion of its travel to the closed position. In an embodiment, the damper piston chamber 233 may be configured to receive an amount of fluid sufficient to allow the closure member 275 to be quickly displaced over about the last 60% of its travel (e.g., going from about 40% from the open position until the full closed position), over about the last 50% of its travel, over about the last 40% of its travel, over about the last 30% of its travel, over about the last 20% of its travel, over about the last 10% of its travel, or over about the last 5% of its travel.

The damper piston assembly 230 may be configured to accept the portion of the control fluid displaced from the piston chamber 223 over any portion of the damper piston 235 travel within the damper piston chamber 233. For example, the damper piston 235 may fully traverse the length of the damper piston chamber 233 while accepting the control fluid, or the damper piston 235 may only travel over a portion of the length of the damper piston chamber 233 while accepting the control fluid, regardless of the starting and/or ending points of the damper piston 235 travel within the damper piston chamber 233. The volume of the fluid that the piston chamber 223 (and any additional piston chambers 223) may contain may be larger than the volume of fluid that the damper piston chamber 233 (and any additional damper piston chambers 233) may need to hold and/or accept. In other words, the volume of fluid that the damper piston assembly 230 is configured to accept may be a fraction of the volume of the piston assembly 220 or the total of the piston assemblies to which the damper piston assembly 230 is coupled. In an embodiment, the damper piston chamber 233 may be configured to receive an amount of fluid ranging from about 0.5% to about 100%, about 1% to about 50%, or about 5% to about 30% of the volume of the piston chamber 223 (or of the combined volumes of one or more piston chambers to which the damper piston assembly is fluidly coupled). In an embodiment, the ratio of the volume of the damper piston chamber 233 to the piston chamber 223 may be between about 1:1 to about 1:100, about 1:1.25 to about 1:10, or about 1:1.5 to about 1:5.

Figure 5:
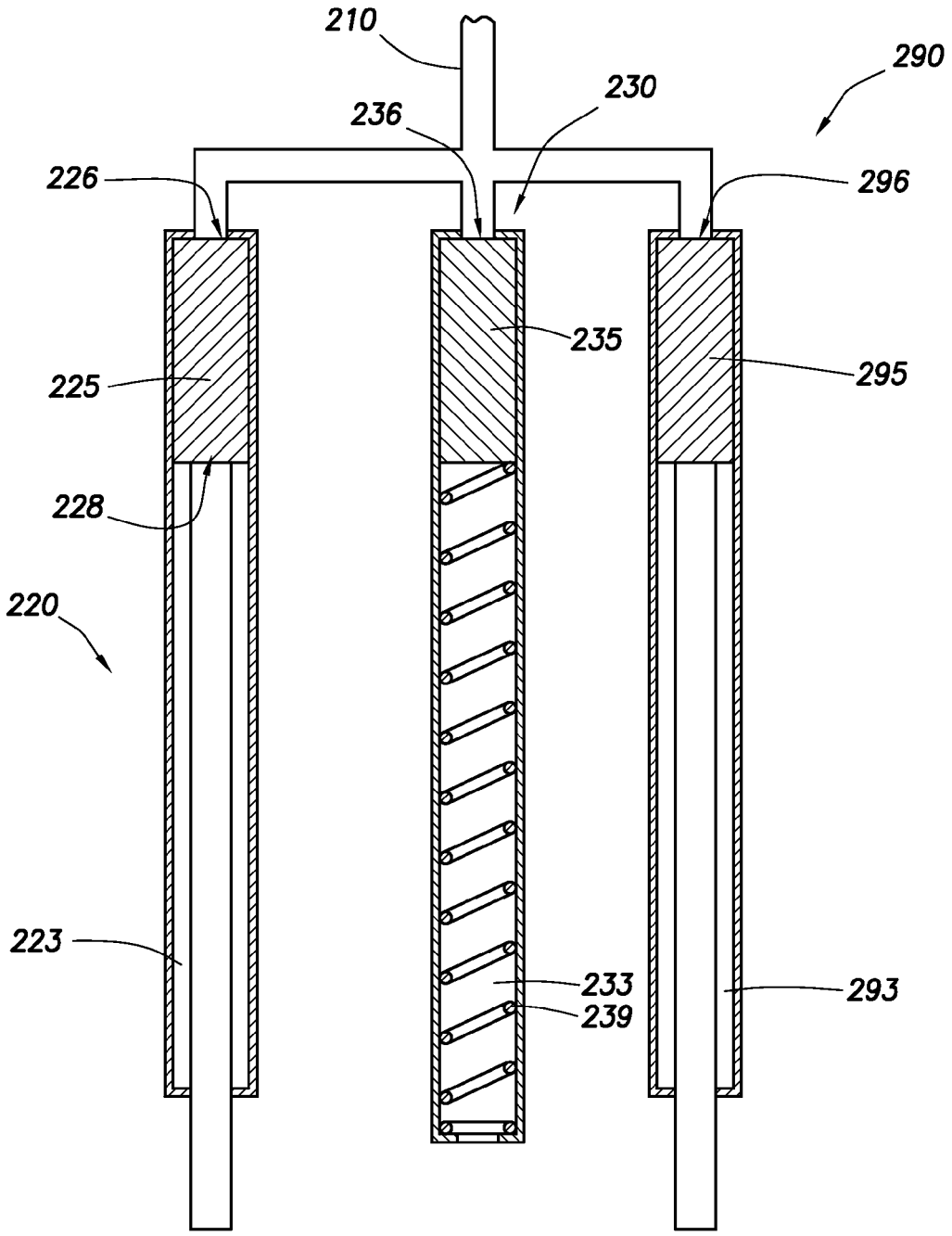
FIG. 5 is a schematic view of an embodiment of a dual piston valve.

When a plurality of valves 200, which may comprise a plurality of piston assemblies 220, are present, the damper piston assembly 230 may be disposed within and/or external to one or more of the valves 200. In some embodiments, a plurality of damper piston assemblies 230 may be present within the valve 200 and/or external to the valve 200. FIG. 5 schematically illustrates a system comprising a plurality of piston assemblies 220, 290 in fluid communication with a damper piston assembly 230. In addition to the first piston assembly 220 and the damper piston assembly 230, a second piston assembly 290 may be present in the same valve 200 as the first piston assembly 220 or within a different valve. In an embodiment, the second piston assembly 290 may be the same or similar to the first piston assembly 220. For example, the second piston assembly 290 may comprise a piston chamber 293 having a piston 295 sealably disposed therein and configured for reciprocating movement within the piston chamber 293. The piston 295 may be coupled to an actuation member as described herein to actuate a valve and/or other downhole component. A first end 296 of the piston 295 may be in fluid communication with the damper piston assembly 230, which in turn can be in fluid communication with the control line 210 and the first piston assembly 220. When a plurality of piston assemblies are present 220, 290, the volume of one or more damper piston assemblies 230 in fluid communication with the plurality of piston assemblies 220, 290 may account for the additional piston assemblies.

Figure 6A:
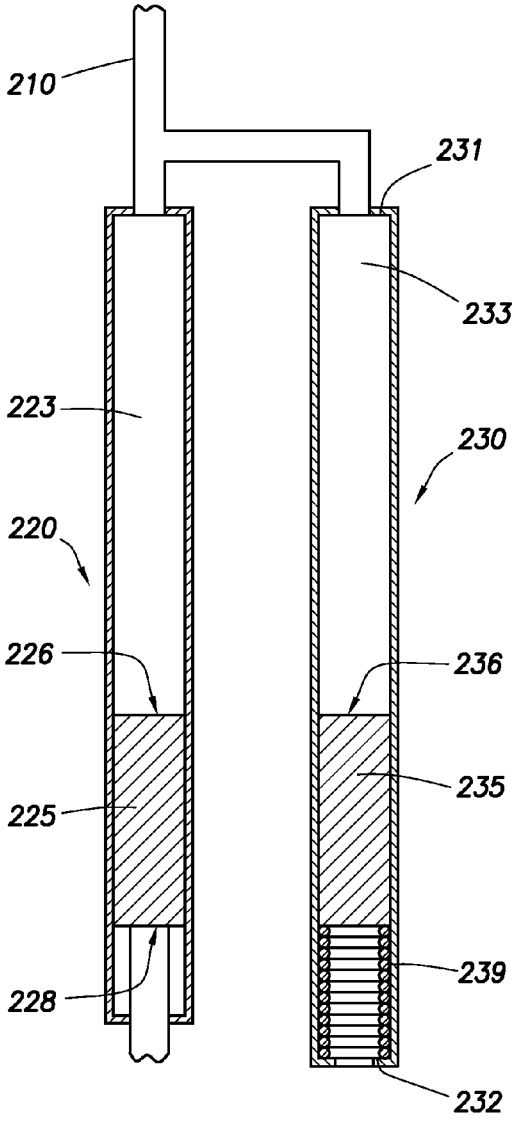
FIG. 6A-6D are schematic views of an embodiment of a power piston and a damper piston according to the present disclosure.

Operation of the valve 200 (e.g., valve 200 and/or valve 290) and damper piston assembly 230 is schematically illustrated in FIGS. 6A to 6D. Referring additionally to FIGS. 3A to 3D, the valve 200 can be opened to allow fluid flow through the longitudinal bore 260 by supplying a pressurized fluid through the control line 210. When the pressure of the fluid in the control line 210 exceeds the force needed to compress the biasing member 245, the piston 225 is forced downwardly, thereby causing the actuator 250 to come into contact with, and open, the closure member 275. At the same time, the pressure of fluid in the control line 210 may exceed the force needed to compress the biasing member 239, thereby forcing the damper piston 235 downward and allowing a portion of the control fluid to flow into the piston chamber 233. The piston assembly 220 and the damper piston assembly may then be configured as illustrated in FIG. 6A, which may be referred to as an open configuration.

Figure 6B:
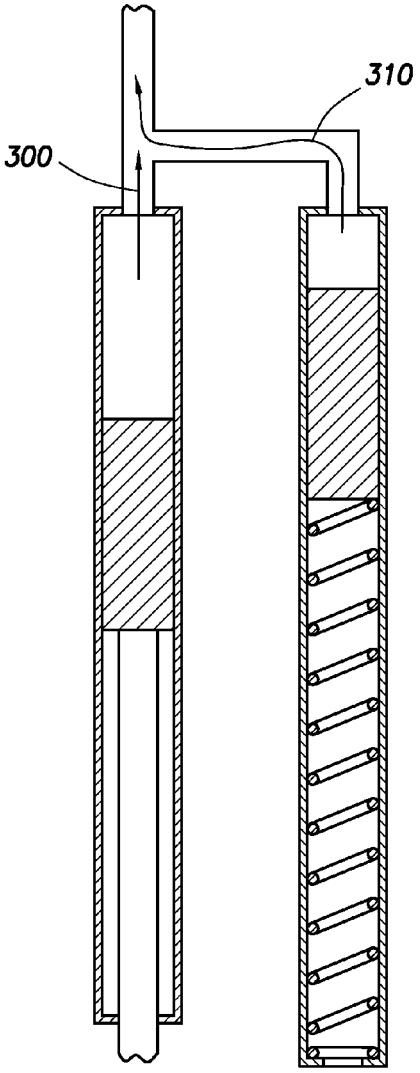

A reduction in pressure of the fluid in the control line 210 may then be used to signal the valve 200 to close (e.g., fail-safe/closed configuration). The pressure reduction may result from the intentional removal of pressure within the control line (e.g., opening a valve at the surface of the wellbore and/or opening a venting valve within the wellbore), the integrity of the control line 210 being compromised (e.g., being cut, damaged, etc.), and/or the leakage of the fluid out of the control line 210. When the pressure in the control line 210 is reduced below the force needed to compress the biasing member 245, the biasing member 245 begins to bias the actuator 250 upwardly away from the closure member 275. The fluid within the piston chamber 223 may follow flow path 300 out of the piston chamber 223 and into the control line 210, as shown in FIG. 6B. The closure member 275 may then begin to rotate into a closed position by action of a hinge 270 and hinge spring 280. Similarly, the biasing member 239 may act upon the damper piston 235, thereby biasing the damper piston 235 towards a first end 231 of the piston chamber 233. The fluid within the damper piston chamber 233 may follow flow path 310 out of the damper piston chamber 233 and into the control line 210. In an embodiment, the damper piston 235 may reach the first end 231 of the damper piston chamber 233, which may act as an up-stop for the damper piston 235, before the piston 225 reaches the top of piston rod chamber 223 because the biasing member 239 may have a higher spring force than the spring force of the power piston 225. In an embodiment, the biasing member 239 and the power piston 225 may have substantially similar spring forces. In this embodiment, the damper piston 235 and the piston 225 may both travel upwards at substantially the same time, and the damper piston 235 and the damper piston chamber 233 may be configured to receive a sufficient volume of fluid during its upward travel to allow the piston 225 to quickly close as the piston 225 nears its closed position, as described in more detail herein. The piston assembly 220 and the damper piston assembly 230 may then be configured as illustrated in FIG. 6B.

The actuator 250 may continue to move upward, exposing the closure member 275 until the actuator 250 approaches the closed position. For example, the closure member 275 may approach a seat or other sealing surface, and the closure member 275 may engage the seat or other sealing surface in the closed position. During the majority of the actuator's 250 movement from the valve 200 open position to the valve 200 closed position, the closure member 275 may be substantially held open by the actuator 250. As a result, the closure member 275 may not substantially extend into the longitudinal bore 260.

Figure 6C:
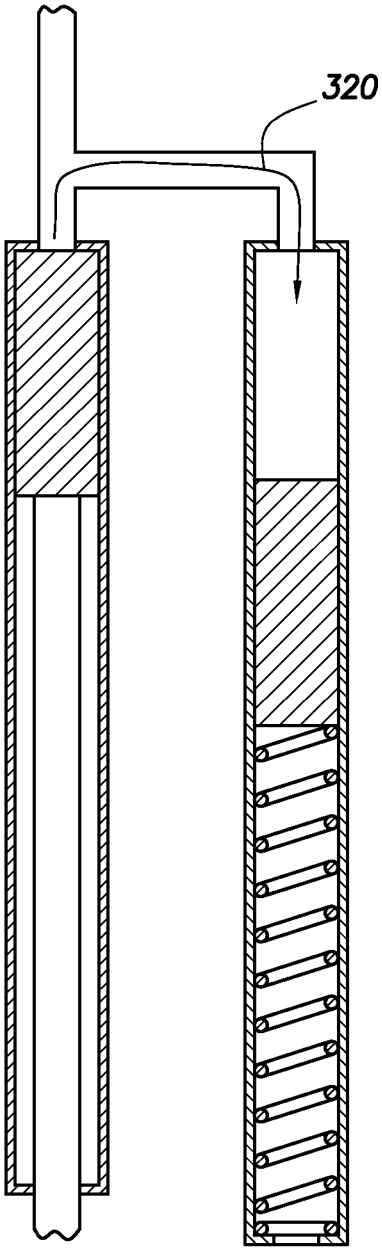

As the actuator 250 continues to move upward and the closure member 275 begins to impinge on the fluid flow through the longitudinal bore 260. The fluid flow through the longitudinal bore 260 may exert a closing force on the closure member 275, and therefore the actuator 250 and the piston 225. The closing force may be sufficient to cause the closure member 275 to quickly close, which may be referred to as a "slam closure." The force on the piston 225 within the piston chamber 223 may cause the pressure within the control line 210 to increase or spike. As illustrated in FIG. 6C, the increased pressure may cause the fluid in the control line 210 to follow flow path 320 and enter the damper piston chamber 233. The increased pressure may exceed the force needed to compress the biasing member 239, and the damper piston 235 may be forced downwardly, thereby allowing at a portion of the control fluid displaced from the piston chamber 223 to flow into the piston chamber 233. As shown in FIG. 6C, the damper piston 235 may only be compressed over a portion of the length of the damper piston chamber 233 when receiving the control fluid. In some embodiments, the damper piston 235 may be fully compressed, and the second end 254 of the damper piston 235 may engage the second end 232 of the damper piston chamber 233 with a metal-to-metal engagement. As a result of the displacement of the fluid into the damper piston chamber 233, the closure member 275 may be allowed to close quickly under the force of the fluid flow in the longitudinal bore 260, thereby limiting or preventing any damage to the hinge 270 and/or the actuator 250 as a result of the force of the engagement between the closure member 275 and the actuator 250. The piston assembly 220 and the damper piston assembly 230 may then be configured as illustrated in FIG. 6C.

While illustrated in FIG. 6C as engaging the first end 231 of the piston chamber 233, the piston 225 may not engage the first end 231 when the closure member 275 has reached the fully closed position. For example, the piston 225 may have about 5% to about 15% of its travel over the length of the piston chamber 223 remaining when the closure member 275 reaches the fully closed position. In this embodiment, the piston 225 may then continue to move upwards due to the biasing force of the biasing member 245. The remaining fluid within the piston chamber 223 may then flow out of the piston chamber 223 and into the control line 210.

Figure 6D:
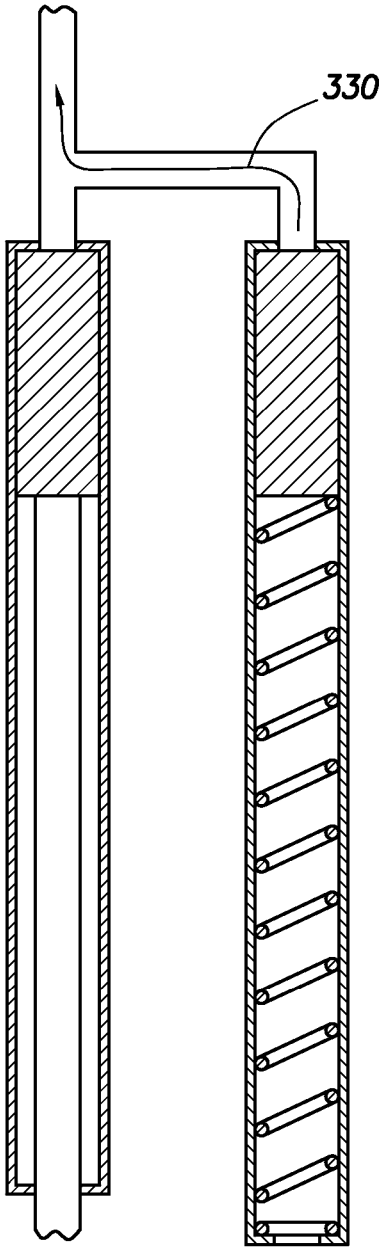

Once the closure member 275 is disposed in the valve closed position, the pressure differential across the closure member 275 may be sufficient to prevent the piston 225 from moving within the piston chamber 223. As shown in FIG. 6D, the biasing force of the biasing member 239 may act upon a second end of the damper piston 235, thereby biasing the damper piston 235 towards a first end 231 of the piston chamber 233. The fluid within the damper piston chamber 233 may then follow flow path 330 out of the damper piston chamber 233 and into the control line 210 until the first end 236 of the damper piston 235 engages the first end 231 of the piston chamber 233. In an embodiment, the engagement between the first end 236 of the damper piston 235 and the first end 231 of the piston chamber 233 may comprise a metal-to-metal engagement, thereby providing a sealing engagement at the metal-to-metal contact. The piston assembly 220 and the damper piston assembly 230 may then be configured as illustrated in FIG. 6D.

A similar process to that discussed with respect to FIGS. 6A to 6D may occur when a plurality of piston assemblies are present and one or more damper piston assemblies are in fluid communication with the plurality of piston assemblies. The valve 200 may be further actuated through the application of a pressure within the control line 210 to actuate the valve from the closed position to the open position as described in more detail herein. This process may be repeated any number of times during the actuation of the valve 200 from the open position to the closed position. As a result, the valve 200 may be used to provide fluid isolation within a wellbore. In an embodiment, the valve 200 may be used to provide fluid communication between a first portion of a wellbore above the valve and a second portion of the wellbore below the valve, where the fluid communication is provided through the longitudinal bore of the valve 200. The valve may then be actuated to the closed position, for example, by decreasing the control line pressure to the valve 200. During at least a portion of the closing of the valve 200, at least a portion of the fluid from the piston used to operate the valve may flow into the damper piston, which may thereby allow the valve to close faster than it would close without the damper piston being in fluid communication with the piston. The first portion of the wellbore may then be isolated from the second portion of the wellbore using the valve.

While described herein in terms of a damper piston receiving a portion of the fluid displaced from a piston assembly during the closing of a downhole tool such as a valve, the damper piston may similarly be used during the opening of a downhole tool such as a valve. For example, the spring force of the biasing member within the damper piston assembly may be weaker than the spring force of the biasing member used with the piston actuating the downhole tool. Upon receiving a control fluid pressure, the damper piston may receive the fluid and be compressed prior to the full compression of the actuation piston. In the event that an opening force (e.g., a slam opening force) is received within the downhole tool, the fluid within the damper piston chamber may be displaced to the actuation piston chamber, thereby allowing the actuation piston to actuate to the open position faster than it would open without the damper piston being in fluid communication with the actuation piston. The damper piston could then transition to the fully compressed state after the actuation piston has actuated to the open position.

Thus, the coupling of the damper piston to a piston assembly may allow the downhole tool to which the piston assembly is coupled to open and/or close faster than it would otherwise open and/or close, respectively, without the damper piston being fluidly coupled to the piston. This configuration may provide protection for the components of a downhole tool such as a valve that is subject to opening and/or closing forces. The reduction or elimination of damage to the components may improve the life of the components and avoid costly maintenance and repair, which in some instances, may require the removal and re-installation of the downhole tool components.

Having described the systems and methods herein, various embodiments may include, but are not limited to:

1. In an embodiment, a downhole tool actuation system comprises a control line in fluid communication with a control fluid source; a first piston assembly comprising a first surface in fluid communication with the control line, wherein the first piston assembly is configured to actuate the downhole tool; and a damper piston assembly comprising a second surface in fluid communication with the first surface.

2. The downhole tool actuation system of embodiment 1, further comprising a third piston assembly comprising a third surface in fluid communication with the control line, wherein the damper piston is in fluid communication with the third surface.

3. The downhole tool actuation system of embodiment 1 or 2, wherein the damper piston assembly is not configured to actuate the downhole tool.

4. The downhole tool actuation system of any of embodiments 1 to 3, wherein the first piston assembly and the damper piston assembly are disposed in a body member of the downhole tool.

5. The downhole tool actuation system of embodiment 4, wherein the damper piston assembly is radially offset from the first piston assembly.

6. The downhole tool actuation system of any of embodiments 1 to 3, wherein the damper piston assembly is disposed externally to the downhole tool.

7. The downhole tool actuation system of any of embodiments 1 to 6, wherein the first piston assembly and the damper piston assembly are disposed within about 300 feet of each other.

8. The downhole tool actuation system of any of embodiments 1 to 7, wherein the damper piston assembly comprises a damper piston disposed within a damper piston chamber, and wherein a first end of the damper piston is configured to engage a first end of the damper piston chamber with a metal-to-metal engagement.

9. The downhole tool actuation system of embodiment 8, wherein a second end of the damper piston is configured to engage a second end of the damper piston chamber with a metal-to-metal engagement.

10. In an embodiment, a downhole valve actuation system comprises a control line in fluid communication with a control fluid source; an actuation piston assembly in fluid communication with a control line, wherein the actuation piston assembly is configured to actuate the valve; and a damper piston assembly in fluid communication with the control line, wherein the damper piston assembly is configured to receive a portion of fluid displaced from the actuation piston assembly.

11. The downhole valve actuation system of embodiment 10, wherein the portion of the fluid displaced from the actuation piston assembly is sufficient to allow a valve closure member to be displaced over about 50% of its travel.

12. The downhole valve actuation system of embodiment 10 or 11, wherein the actuation piston assembly comprises an actuation piston chamber, and wherein the portion of fluid the damper piston is configured to receive is about 0.5% to about 100% of the volume of the actuation piston chamber.

13. The downhole valve actuation system of any of embodiments 10 to 12, wherein the actuation piston assembly comprises an actuation piston chamber, wherein the damper piston assembly comprises a damper piston chamber, and wherein the ratio of a volume of the damper piston chamber to a volume of the actuation piston chamber is between about 1:1 to about 1:100.

14. The downhole valve actuation system of any of embodiments 10 to 13, further comprising a second actuation piston assembly in fluid communication with the control line, wherein the second actuation piston assembly is configured to actuate a second valve.

15. The downhole valve actuation system of any of embodiments 10 to 14, wherein the damper piston assembly is configured to receive the portion of fluid displaced from the actuation piston assembly during the closing of the valve.

16. In an embodiment, a method comprises providing a fluid at a first pressure to a first piston assembly, wherein the first piston assembly comprises a first piston disposed in a first piston chamber, and wherein the first piston is in an actuated state; reducing the first pressure to a second pressure; transitioning the first piston assembly from the actuated state to an un-actuated state in response to the second pressure; and transferring at least a portion of fluid in the first piston chamber to a damper piston assembly during the transitioning.

17. The method of embodiment 16, wherein the first piston is operatively coupled to a valve closure member, wherein the valve closure member provides fluid communication through a valve in the actuated state, and wherein the valve closure member isolates fluid communication through the valve in the un-actuated state.

18. The method of embodiment 16 or 17, wherein the transferring comprises reducing a force applied to the first piston assembly.

19. The method of any of embodiments 16 to 18, wherein the first piston assembly transitions from the actuated state to an un-actuated state faster than a comparative piston assembly that does not transfer the portion of the fluid.

20. The method of any of embodiments 16 to 19, further comprising receiving, by the damper piston assembly, a second portion of fluid from a second piston assembly during the transitioning.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A downhole tool actuation system comprising:

a control line in fluid communication with a control fluid source;

a first piston assembly comprising a first piston disposed within a first piston chamber, wherein a first surface of the first piston is in fluid communication with the control line, and wherein the first piston assembly is configured to actuate the downhole tool; and a damper piston assembly comprising:

a damper piston chamber;

a damper piston disposed within the damper piston chamber; and a biasing member disposed within the damper piston chamber;

wherein a second surface of the damper piston is in fluid communication with the first surface of the first piston and in fluid communication with the control line;

wherein the biasing member acts upon an end of the damper piston opposite the second surface of the damper piston to bias the damper piston toward the control line.

2. The downhole tool actuation system of claim 1, further comprising a third piston assembly comprising a third piston disposed within a third piston chamber, wherein a third surface of the third piston is in fluid communication with the control line, and wherein the second surface of the damper piston is in fluid communication with the third surface.

3. The downhole tool actuation system of claim 1, wherein the first piston assembly and the damper piston assembly are disposed in a body member of the downhole tool.

4. The downhole tool actuation system of claim 3, wherein the damper piston assembly is radially offset from the first piston assembly.

5. The downhole tool actuation system of claim 1, wherein the damper piston assembly is disposed externally to the downhole tool.

6. The downhole tool actuation system of claim 1, wherein the first piston assembly and the damper piston assembly are disposed within about 300 feet of each other.

7. The downhole tool actuation system of claim 1, wherein a first end of the damper piston is configured to engage a first end of the damper piston chamber with a metal-to-metal engagement; and wherein a second end of the damper piston is configured to engage a second end of the damper piston chamber with a metal-to-metal engagement.

8. A downhole valve actuation system comprising:

a control line in fluid communication with a control fluid source;

an actuation piston assembly comprising an actuation piston disposed within an actuation piston chamber, wherein the actuation piston assembly is in fluid communication with the control line, wherein the actuation piston assembly is configured to actuate the valve to an open position in response to a fluid at a first pressure being provided by the control line to the actuation piston assembly; and a damper piston assembly comprising a damper piston disposed within a damper piston chamber, wherein the damper piston assembly is in fluid communication with the control line, wherein the damper piston assembly is configured to receive a portion of the fluid displaced from the actuation piston assembly in response to a reduction in fluid pressure from the first pressure to a second pressure through the control line.

9. The downhole valve actuation system of claim 8, wherein the portion of the fluid displaced from the actuation piston assembly is sufficient to allow a valve closure member to be displaced over about 50% of its travel.

10. The downhole valve actuation system of claim 8, wherein the portion of fluid the damper piston assembly is configured to receive is about 0.5% to about 100% of the volume of the actuation piston chamber.

11. The downhole valve actuation system of claim 8, wherein the ratio of a volume of the damper piston chamber to a volume of the actuation piston chamber is between about 1:1 to about 1:100.

12. The downhole valve actuation system of claim 8, further comprising a second actuation piston assembly comprising an actuation piston disposed within a second actuation piston chamber, wherein the second actuation piston assembly is in fluid communication with the control line, wherein the second actuation piston assembly is configured to actuate a second valve.

13. The downhole valve actuation system of claim 8, wherein the damper piston assembly is configured to receive the portion of fluid displaced from the actuation piston assembly during the closing of the valve.

14. The downhole valve actuation system of claim 8, wherein the damper piston assembly comprises:

a damper piston chamber;

a damper piston disposed within the damper piston chamber; and a biasing member disposed within the damper piston chamber, wherein the biasing member biases the damper piston toward the control line.

15. A method comprising:

providing a fluid at a first pressure from a control line to a first piston assembly, wherein the first piston assembly comprises a first piston disposed in a first piston chamber, and wherein the first piston is in an actuated state;

opening a valve in response to the fluid at the first pressure actuating the first piston assembly;

reducing the first pressure to a second pressure;

transitioning the first piston assembly from the actuated state to an un-actuated state in response to the reduction in fluid pressure from the first pressure to the second pressure; and transferring at least a portion of the fluid from the first piston chamber to a damper piston chamber of a damper piston assembly during the transitioning, wherein the damper piston assembly is separate from the first piston assembly and comprises a damper piston disposed in the damper piston chamber.

16. The method of claim 15, wherein the first piston is operatively coupled to a valve closure member, wherein the valve closure member provides fluid communication through the valve in the actuated state, and wherein the valve closure member isolates fluid communication through the valve in the un-actuated state.

17. The method of claim 15, wherein the transferring comprises reducing a force applied to the first piston assembly.

18. The method of claim 15, wherein the first piston assembly transitions from the actuated state to an un-actuated state faster than a comparative piston assembly that does not transfer the portion of the fluid.

19. The method of claim 15, further comprising receiving, by the damper piston chamber of the damper piston assembly, a second portion of fluid from a second piston assembly during the transitioning, wherein the second piston assembly is separate from the damper piston assembly and comprises a second piston disposed in a second piston chamber.

20. The method of claim 15, further comprising biasing the damper piston against the portion of fluid incoming to the damper piston chamber via a biasing member.

* * * * *